US009542816B1

(12) United States Patent
Mor et al.

(10) Patent No.: US 9,542,816 B1
(45) Date of Patent: Jan. 10, 2017

(54) WEARABLE ALERT DEVICE HAVING SELECTABLE ALERT VOLUME AND METHOD OF OPERATING SAME

(71) Applicant: VSN TECHNOLOGIES, INC., Fort Lauderdale, FL (US)

(72) Inventors: Tal Mor, Coral Springs, FL (US); Amit Verma, Sunrise, FL (US); Vinosh Diptee, Sunrise, FL (US); Moises De La Cruz, Miramar, FL (US); Hao Nguyen, Lake Worth, FL (US)

(73) Assignee: VSN TECHNOLOGIES, INC., Fort Lauderdale, FL (US)

( * ) Notice: Subject to any disclaimer, the term of this patent is extended or adjusted under 35 U.S.C. 154(b) by 428 days.

(21) Appl. No.: 14/278,032

(22) Filed: May 15, 2014

(51) Int. Cl.

| | |
|---|---|
| ***G08B 1/08*** | (2006.01) |
| ***G08B 3/10*** | (2006.01) |
| ***H04R 17/00*** | (2006.01) |
| ***H04R 3/00*** | (2006.01) |

(52) U.S. Cl.
CPC ..... *G08B 3/1025* (2013.01); *H04R 3/00* (2013.01); *H04R 17/00* (2013.01); *H04R 2217/01* (2013.01); *H04R 2400/03* (2013.01); *H04R 2430/01* (2013.01)

(58) Field of Classification Search
CPC ..... G08B 1/08
See application file for complete search history.

(56) References Cited

U.S. PATENT DOCUMENTS

| | | | | |
|---|---|---|---|---|
| 5,337,041 | A * | 8/1994 | Friedman | G08B 21/0216 340/539.1 |
| 5,347,495 | A * | 9/1994 | Cherek | B06B 1/0207 333/32 |
| 5,574,433 | A * | 11/1996 | Bahcall | G08B 21/0297 340/574 |
| 5,881,021 | A * | 3/1999 | Pirie | B06B 1/0284 340/514 |
| 6,016,099 | A * | 1/2000 | Campman | G08B 21/0415 340/321 |
| 6,018,466 | A * | 1/2000 | Lucian | H02M 3/28 363/16 |
| 6,593,851 | B1 * | 7/2003 | Bornstein | G08B 21/0227 340/539.15 |
| 6,930,608 | B2 * | 8/2005 | Grajales | A61B 5/0002 128/202.19 |
| 7,515,044 | B2 * | 4/2009 | Welch | A61B 5/0024 340/286.07 |
| 8,301,236 | B2 * | 10/2012 | Baumann | A61B 5/0404 128/904 |

(Continued)

*Primary Examiner* — Jennifer Mehmood
*Assistant Examiner* — John Mortell
(74) *Attorney, Agent, or Firm* — Patents on Demand P.A.; Brian K. Buchheit; Scott M. Garrett

(57) ABSTRACT

A wearable alert device includes an audio transducer and driver circuit that allows selection of either a high or low volume setting for driving the transducer. The driver circuit is operable in a single ended mode for low volume and a double ended mode for high volume. The single ended mode holds one terminal of the transducer low while the other is driven in correspondence with a clock signal, while the double ended mode drives one terminal in correspondence with the clock signal and the other terminal is inverted from the clock signal. The transducer is activated in response to an alert event, and can be driven according to a profile or pattern.

20 Claims, 4 Drawing Sheets

(56) References Cited

U.S. PATENT DOCUMENTS

| | | | | |
|---|---|---|---|---|
| 9,024,748 | B2 * | 5/2015 | Haase | G08B 21/02 340/532 |
| 2002/0039427 | A1 * | 4/2002 | Whitwell | H04R 1/1091 381/312 |
| 2004/0032333 | A1 * | 2/2004 | Hatt | G08B 25/016 340/574 |
| 2007/0200716 | A1 * | 8/2007 | Haase | G08B 15/004 340/574 |
| 2008/0198023 | A1 * | 8/2008 | Hansen | A61B 5/0002 340/573.1 |
| 2008/0266118 | A1 * | 10/2008 | Pierson | A61B 5/0205 340/573.6 |
| 2012/0179004 | A1 * | 7/2012 | Roesicke | A61B 5/0024 600/301 |
| 2014/0028456 | A1 * | 1/2014 | Sadhu | G08B 21/18 340/539.13 |

* cited by examiner

WEARABLE ALERT DEVICE HAVING SELECTABLE ALERT VOLUME AND METHOD OF OPERATING SAME

FIELD OF THE DISCLOSURE

The present disclosure relates generally to wearable electronic devices, and more particularly to wearable alert devices that provide an audible and/or tactile vibrational alert.

BACKGROUND

Alert devices have been in use for some time, and are typically used with a proprietary base unit. These devices can be worn, such as in the form of a necklace, and typically have a button that can be pressed by the user, causing the device to send a signal to the base unit. The base unit is usually connected to a phone line to place an automated call to a monitoring agency, which charges a fee for the monitoring service. Given the limited functionality of these devices, they are typically only used for medical emergencies or other situations where the user is unable to help themselves. Conventional alert devices, however, are one way devices. That is, they only transmit a signal to the base unit. Furthermore, they have a limited range since the base unit is not moveable.

More recently, some manufacturers have developed wearable devices that can connect with mobile communication device using, for example, the BlueTooth protocol. When these devices are connected to each other wirelessly, they are "paired." These devices, however, tend to be fairly sophisticated. They often include, for example, a graphical display for visually displaying information. Essentially they are scaled-down version of the mobile device with which they are paired, providing limited access to resources on the mobile communication device. As a result, they can be somewhat expensive, as well as complicated to use for simple alert applications.

Accordingly, there is a need for a wearable alert device that can be paired with a mobile communication device that can be used to both receive alert messages and alert the user, as well as to send alert events to the mobile communication device that can accomplish these goals without the expense of devices that merely replicate functions of the mobile communication device.

BRIEF DESCRIPTION OF THE FIGURES

In the accompanying figures like reference numerals refer to identical or functionally similar elements throughout the separate views, together with the detailed description below, and are incorporated in and form part of the specification to further illustrate embodiments of concepts that include the claimed invention and explain various principles and advantages of those embodiments.

Figure 1:
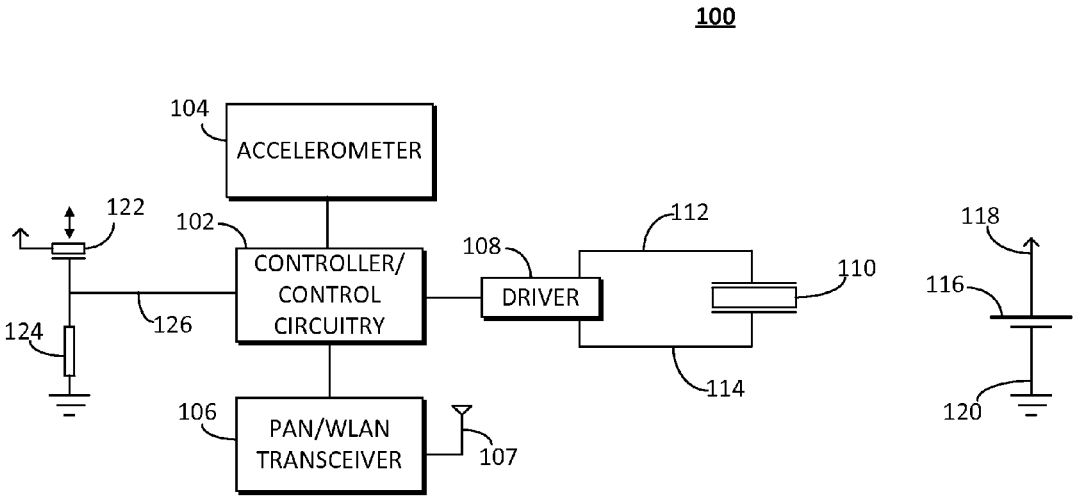
FIG. 1 is a block schematic diagram of a wearable alert device having a selectable alert volume in accordance with some embodiments.

Those skilled in the field of the present disclosure will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. Well known elements, structure, or processes that would be necessary to practice the invention, and that would be well known to those of skill in the art, are not necessarily shown and should be assumed to be present unless otherwise indicated.

DETAILED DESCRIPTION

In the following disclosure various embodiments are shown and described. On such embodiment includes a wearable alert device that includes a housing enclosing a sealed volume, an audio transducer element disposed in the sealed volume, a driver circuit disposed in the sealed volume that selectively drives the audio transducer in either a single ended mode or a double ended mode responsive to an enable signal, and control circuitry disposed in the sealed volume that includes a personal area network (PAN) interface and a clock signal source that produces a clock signal. The control circuitry applies the clock signal and enable signal to the driver circuit responsive to receiving an alert message at the PAN interface, wherein the enable signal is controlled to have a state that is on, off, or alternating based on an audio profile used responsive to receiving the alert message.

FIG. 1 is a block schematic diagram of a wearable alert device 100 having a selectable alert volume in accordance with some embodiments. The alert device 100 is configured in a wearable configuration, and includes a controller or control circuitry 102 that control operation of the alert device 100. The control circuitry 102 can include a microcontroller or microprocessor, and memory. The memory can include read only memory (ROM) as well as random access memory (RAM). The ROM can include instruction code that is executed by the controller or processor, while the RAM can be used to store values, settings, and other data to be used by the instruction code when being executed. The control circuitry 102 can also receive input from other circuits, such as, for example, an accelerometer 104. The accelerometer 104 can, in some embodiments, provide an indication of an acceleration event such as would be consistent with the user falling, for example. The accelerometer 104 can be configured, for example, to provide an interrupt to the control circuit 102 in the event of a high acceleration event. In some embodiments, the accelerometer 104 can provide three dimensional acceleration information, allowing the control circuit 102 to determine it orientation, as well as movement, as is known.

The control circuitry 102 is further coupled to a wireless transceiver 106, which can be a personal area network (PAN) transceiver or a wireless local area network (WLAN) transceiver. An example of a PAN transceiver is a transceiver that operates in conformance with a standard according to the Institute of Electrical and Electronics Engineers (IEEE) standard 802.15. An example of a WLAN transceiver is a transceiver that operates in conformance with a standard according to IEEE standard 802.11. The transceiver 106 include radio circuitry for communicating over an antenna 107 so that it can both transmit and receive radio frequency signals. In some embodiments, where the transceiver 106 is a PAN transceiver, the PAN transceiver can pair with another device, such as a mobile communication device. Thus, in some embodiments for example, in response to an acceleration event as indicated by the accelerometer, the control circuit 102 can control the transceiver 106 to send an alert message to another device indicating the occurrence of the acceleration event. At the same time, the control circuitry can let the user of the alert device 100 know that the acceleration event has been detected via a tactile alert. In some embodiments the tactile alert can be given first, before transmitting an alert message, to give the user an opportunity to respond so as to indicate that the alert does not need to be transmitted (i.e. it was not an emergency).

The tactile alert is provided by a driver circuit 108 which drives a vibrational transducer 110. The vibrational transducer 110 can be, for example, a piezo element. The driver circuit 108 can, responsive to the a control or enable signal from the control circuitry 102, provide different drive signals to the transducer 110. For example, on line 112 the driver circuit 108 can provide a clock signal, which is essentially a square wave that can be generated by circuitry in the control circuitry 102. On line 114 the driver circuit can provide a ground to achieve a low volume vibration of the transducer 110, or an inverted clock signal that is an inverted version of the signal on line 112 to achieve a high volume vibration. By inverting the signal on line 112 on line 114, the alert device can achieve 6-9 decibels (dB) of volume increase over holding line 114 at the ground level. In addition to using different volume levels, the control circuitry 102 can cause the driver circuit 108 to drive the transducer 110 in various patterns of off, low, and high volume. Different patterns can be assigned to different applications so that the user can determine the nature of an alert by perceiving the pattern. In some embodiments the volume of the vibration can be selected, such as by use of a button 122 on the alert device 100. The button 122 can be pressed to connect a voltage level to a button input line 126. When the button is not pressed a pull down resistor 124 can keep the button input line 126 low. In some embodiments, in addition to selecting a volume level for the transducer 110, the button can be used to respond to alerts (i.e. to stop an alert). In some embodiments, pressing the button 122 can generate an alert event, causing the alert device to transmit an alert message via the transceiver. The voltage can be supplied by a battery 116, that provides a battery voltage 118 and ground 120 for the button 122 as well as the other circuitry of the alert device 100.

Accordingly, the alert device can, for example, receive a message via the transceiver 106, and in response, generate a vibration via the transducer 110 to alert the wearer. In some embodiments the alert can be a simple vibration of a predetermined duration, at either the low or high volume setting, as selected by the user/wearer. In some embodiments the vibration of the transducer can be patterned (i.e. variations of off/low/high volume) based on information in a message received via the transducer to indicate a type of alert. In some embodiments the button 122 can be pressed to indicate acknowledgement of the alert (which can also prompt the alert device 100 to transmit an acknowledgement via the transceiver to the device that sent the alert message). In some embodiments the button 122 can be pressed momentarily to toggle the transducer volume, and held down in order to generate an alert that is transmitted by the alert device 100 via the transceiver 106.

The alert device 100 can be sealed, such that all of the components shown in FIG. 1 are within a housing, where the button 122 is actuated by a member on the outside of the housing, or that forms part of the housing. The housing can be opened so as to replace the battery 116. Being sealed, there are no acoustic ports, and the air volume inside the alert device 100, once closed, is substantially isolated from the ambient air. In some embodiments, the transducer itself can have a resonant frequency that is substantially different than that of the alert device 100 when the components and battery 116 are mounted inside the alert device 100, and the drive or clock signal used to drive the transducer 110 can be at the resonant frequency of the alert device 100 as assembled, rather than at the resonant frequency of the transducer 110. It will be appreciated by those skilled in the art that, by using a piezo element for the transducer 110, as opposed to a conventional vibrator comprising a motor and eccentric weight, less power is drawn from the battery 116 to generate alert vibrations. Thus, the battery 116 can be, for example, a small coin cell which can last for a year or long in some embodiments.

Figure 2:
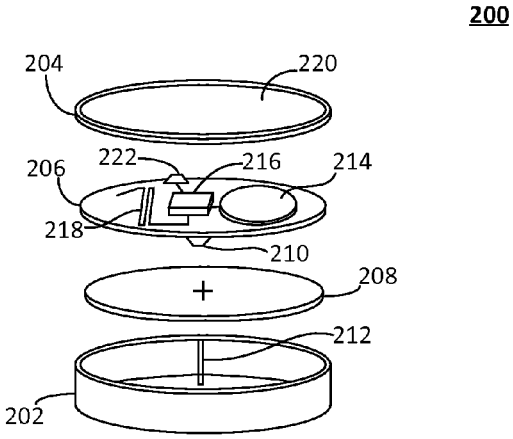
FIG. 2 is an exploded view of an puck device for use as a wearable alert device in accordance with some embodiments.

FIG. 2 is an exploded view of an puck device 200 for use as a wearable alert device in accordance with some embodiments. The puck device 200 is an example of an alert device such as alert device 100 of FIG. 1. The puck device can include a housing 202 into which is disposed a battery 208, and a circuit board 206. A top or cover 204 covers and seals the puck device 200. The circuit board 206 includes a positive battery contact 210 for connecting to the positive side of the battery 208. A negative contact 212 makes contact with the negative side of the battery and provides a ground to the circuit board 206. The circuit board includes a transducer 214, and circuitry 216. The circuitry 216 can be, for example, an integrated circuit that includes the control circuitry, accelerometer, driver circuit, and transceiver. The circuit board can also include an antenna element 218 for transmitting and receiving radio frequency signals via the transceiver. The cover 204 can include a button actuator 220 that can be used to actuate a switch element 222 on the circuit board 206. The battery 208 can be, for example, a coin cell, such as those sold by under the designation CR2032. The transducer 214 can be a piezo element that is rigidly mounted to the circuit board 206, and the circuit board 206 can be rigidly mounted in the housing 202. Thus, vibrations of the transducer 214 are propagated through the circuit board and into the housing. In some embodiments the transducer 214 can be mounted directly on the housing 202, and driven through electrical contacts disposed on the circuit board that make electrical connection to the transducer terminals. The configuration of the circuit board 206, housing 202, battery 208, and cover 204 result in a system having a resonant frequency, meaning a frequency at which the greatest vibrational amplitude occurs, which can be substantially different than the resonant frequency of the transducer element 214. Accordingly, rather than driving the transducer 214 at its resonant frequency, it can be driven at the resonant frequency of the assembled puck device 200.

Figure 3:
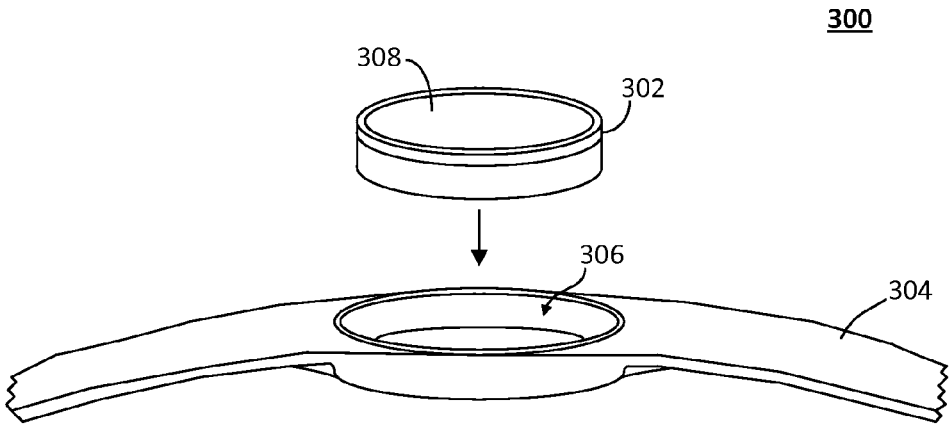
FIG. 3 is a is a wearable alert device including a puck and a wrist strap in accordance with some embodiments.

FIG. 3 is a is a wearable alert device 300 including a puck device 302 and a wrist strap 304 in accordance with some embodiments. The wrist strap 304 can be configured to be worn by a user on the user's wrist, like a wristwatch or bracelet. The puck device 302 can be substantially similar to the puck device 200 of FIG. 2, and can fit within a pocket 306 formed in the wrist strap 304. The wrist strap 304 can be formed of a compliant material such as, for example, rubber, and the pocket 306 can be sized to retain the puck device 302 by friction. Ridges or other retaining features can be used to retain the puck device 302 in the pocket 306 as well. The bottom of the puck device 302 can be exposed through the pocket, so as to make contact with the wearer's skin. The puck device 302 can have a button actuator 308 on the top surface of the puck device 302 to make it easy for the user to actuate the button, as needed.

Figure 4:
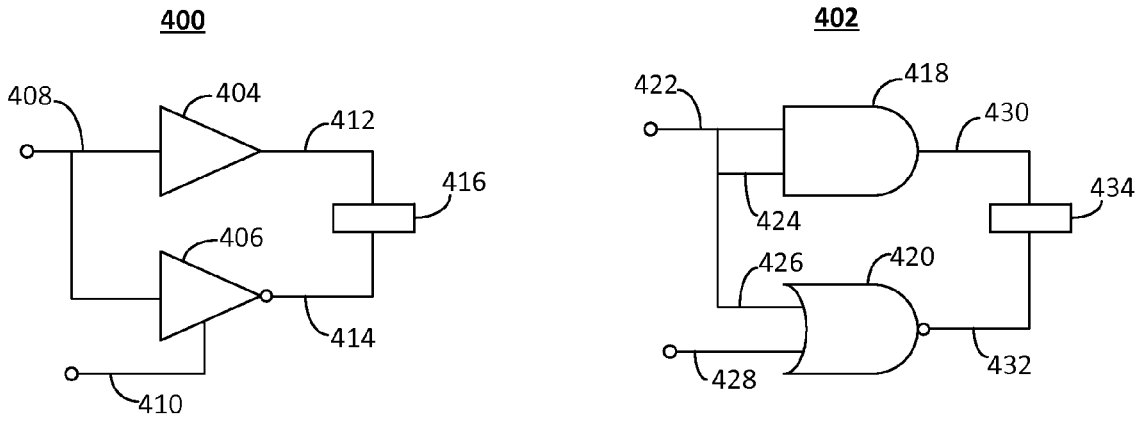
FIG. 4 is a schematic logic diagram of alternative driver circuits for driving an acoustic transducer at different volume levels in accordance with some embodiments.

FIG. 4 is a schematic logic diagram of alternative driver circuits 400, 402 for driving an acoustic transducer at different volume levels in accordance with some embodiments. In general, each driver circuit 400, 402 has an input and an enable or select line. Each driver circuit provides a first logic driver path connected to a first terminal of the transducer and a second driver logic path connected to the second terminal of the transducer. The enable line operates a gating element such that when the enable line is not asserted, the resulting output to the transducer is a single ended driving mode where one terminal is held constant and the other terminal is driven in correspondence with the input clock signal. When the enable line is asserted, the transducer is driven in a double-ended mode, where the terminals are inverted with respect to each other each clock cycle; when one terminal is low, the other is high, and vice versa.

In the first driver circuit 400 a buffer 404 and an inverter 406 are used. The buffer 404 provides an output on line 412 to a first terminal of a transducer 416, and the output on line 412 corresponds to an input on line 408. That is, when line 408 is high, the output on line 412 will be high, and when the input 408 is low, the output 412 will be low. The inverter 406 is enableable via an enable input 410. When the enable input 410 is low, the inverter 406 only provides a low output, even though its input is tied to the input of the buffer 404. When the enable input 410 is asserted, then the inverter output 414 is inverted from its input, thereby driving the transducer in double-ended mode.

In the second driver circuit 402, a AND gate 418 has two inputs 422, 424 that are commonly connected to a clock input (or other driving signal). The clock input 422 is also provided to one input 426 of a NOR gate 420. A second input 428 of the NOR gate is used to enable or disable double ended driving mode. Since the inputs 422, 424 of the AND gate 418 are tied together, the output 430 of the AND gate will follow the input signal (i.e. the clock signal). When the enable input 428 of the NOR gate 420 is low, the output 432 will always be low, thereby driving the transducer 434 in single ended mode. When the enable input 428 is asserted, then the output 432 will be the inverse of the input 426, thereby driving the transducer in double ended mode. Driving the transducer 416, 434 in double ended mode effectively doubles the voltage differential at which the transducer 416, 434 is driven over that of single ended mode, resulting in a substantial increase in amplitude, and the resulting volume produced by the transducer 416, 434.

The enable signal provided to the driver circuit can be controlled to have a state that is on, off, or alternating (i.e. as a pattern) based on an audio profile used responsive to receiving the alert message. In some embodiments different alerts can be established as profiles, either in the wearable alert device or in the associated mobile communication device. In some embodiments the user can customize the profile using an application on the associated mobile communication device to specify a pattern to be used with a given alert type, or in general.

Figure 5:
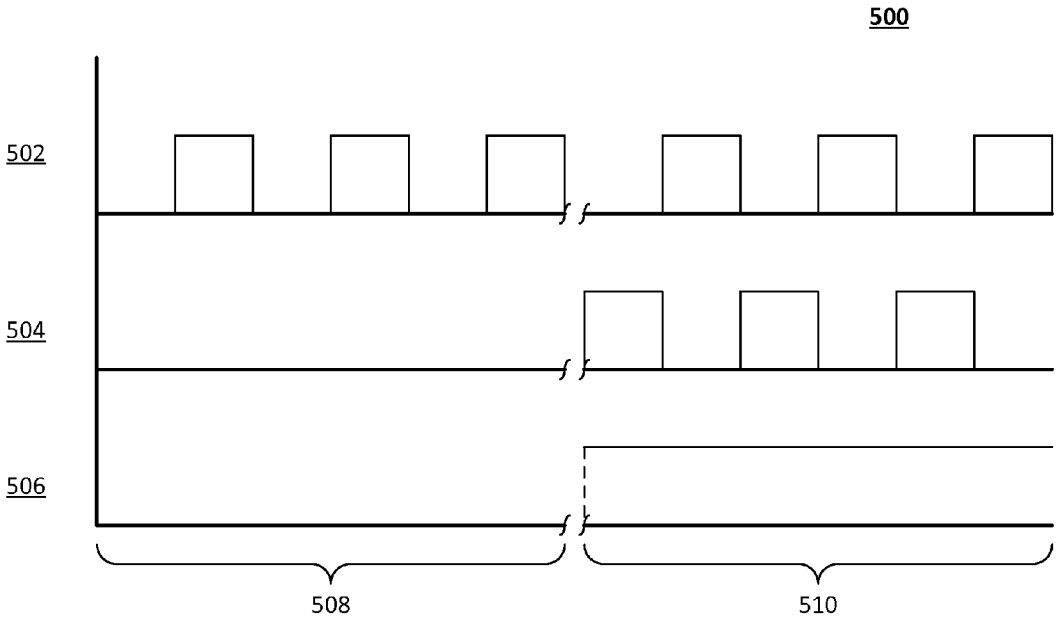
FIG. 5 is a timing diagram showing the driving signals at low and high volume levels for driving an acoustic transducer in accordance with some embodiments.

FIG. 5 is a timing diagram 500 showing the driving signals at low and high volume levels for driving an acoustic transducer in accordance with some embodiments. The signals are graphed with respect to time an amplitude, with time being the horizontal axis, and increasing from left to right, and amplitude being on the vertical axis and increasing from bottom to top. The signals include a first driving signal 502, and second driving signal 540, and an enable signal 506. The first driving signal can be, for example, the output 430 of the AND gate 418 of FIG. 4, which the second driving signal 504 can be, for example, the output 432 of the NOR gate 420 of FIG. 4. The enable signal 506 can be the enable signal in enable input 428 of the NOR gate 420 of FIG. 4. The diagram 500 is broken into two time periods; a single ended time period 508 and a double ended time period 510.

The driving signals 502, 504 represent driving signals for driving a transducer in an alert device to alert a user through vibration and sound. In the single ended time period 508, the enable signal 506 is not asserted (i.e. low). As a result, the output second driving signal 504 is also a constant low while the first driving signal 502 follows the clock signal input, and varies between high and low accordingly. In the double ended time period 510, the enable signal 506 is asserted. As a result, the second driving signal 504 is inverted with respect to the first driving signal 502.

Figure 6:
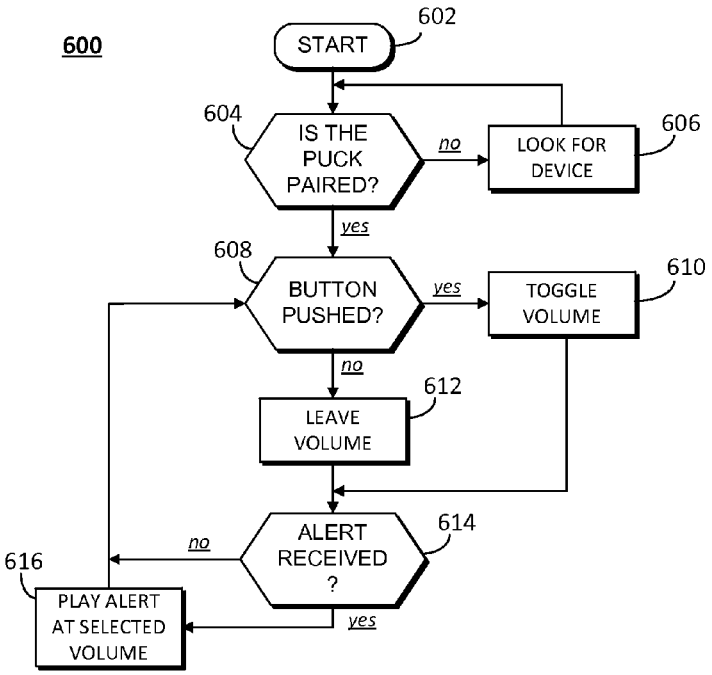
FIG. 6 is a flow chart diagram of a method for operating an alert device in accordance with some embodiments.

FIG. 6 is a flow chart diagram of a method 600 for operating an alert device in accordance with some embodiments. The method 600 illustrates one of many methods that can be used in a wearable alert device such as that exemplified in FIGS. 1-3. In particular, the method 600 can be performed by a wearable alert device and shows how volume can be selected by a user and used to provide an alert at the selected volume level, in accordance with some embodiments.

At the start 602, the wearable alert device is powered on, and a volume setting can be established, either a low volume level resulting from driving the transducer in single ended mode, or a high volume resulting from driving the transducer in double ended mode. The volume at the start can be determined from a saved volume setting or it can always start at a default setting. In step 604 the method 600 can determine if the alert device is presently paired with another device, such as a mobile communication device (e.g. a "smart" cellular telephone device). If not, the method can loop through step 606 where it looks for a pairing, either to establish a pairing, or to find an established pairing. If, in step 604, the method 600 determines that the device is presently paired with another device, the method can proceed to step 608 where the method 600 determines whether a user input is being received by the button being actuated. If the button is actuated, the method 600 can toggle the volume setting in step 610. By "toggle" it is mean that if the present setting in step 608 is low, then in step 610 it is changed to high. Likewise, if in step 608 the present volume setting is high, then in step 610 it is changed to low. In step 608 if the button is not actuated, the method can leave the volume setting unchanged as indicated by step 612. In step 614 the method determines whether an alert has been received or generated. If an alert has been received in step 614, then in step 616 the method plays an alert at the selected volume level (i.e. either low or high). The method can then loop back to step 608.

It will be appreciated by those skilled in the art that the various steps of the method 600 can be performed in various processes. For example, step 614 can be the result of an interrupt, rather than always occurring after checking whether the button is actuated in step 608, for example, Similarly, various debounce timers and back off timers can be used so that, when actuation of the button is detected in step 608, it is toggled and then the button input can be ignored for a period of time after it is released so as not to allow switching noise to be read as a button actuation.

Figure 7:
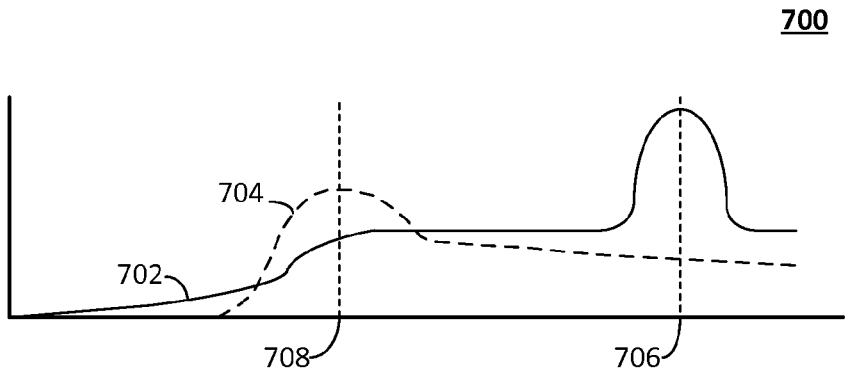
FIG. 7 is a graph chart comparing the audio frequency response of an acoustic transducer with the acoustic frequency response of an alert device in accordance with some embodiments.

FIG. 7 is a graph chart 700 comparing the audio frequency response of an acoustic transducer with the acoustic frequency response of an alert device in accordance with some embodiments. The chart 700 graphs frequency along the horizontal axis and response magnitude along the vertical axis. The frequency response of the transducer element 702 has a peak at frequency 706. A resonant frequency band can be defined as the frequency band around the peak frequency 706 that is within 3 dB of the peak magnitude. The frequency response 702 is typical of a piezo element, having a substantially flat region before the peak at the peak frequency 706, which can be at an ultrasonic frequency. Conversely, the frequency response 704 of the audio transducer of the alert device (e.g. that exemplified in FIGS. 1-3) has a peak at a much lower frequency 708, which can be in the audio range (i.e. able to be heard by most people having normal hearing perception). In some embodiments the lower frequency 708 can be for example, in the range of 5000-8000 Hz. This graph chart shows, therefore, the effect of components such as the housing, circuit board, battery, and so on, and how they can be configured to have a resonant or natural frequency response at an audible frequency. Therefore, while the transducer alone has a peak response at frequency 706, it should be driven at frequency 708 to maximize the audible and tactile effect of the alert, when an alert event occurs. When the frequency of the clock signal is not in the resonant frequency band around peak 706, and is instead at the peak of the response of the device 708, the result produces a maximum sound pressure level outside the wearable alert device.

Figure 8:
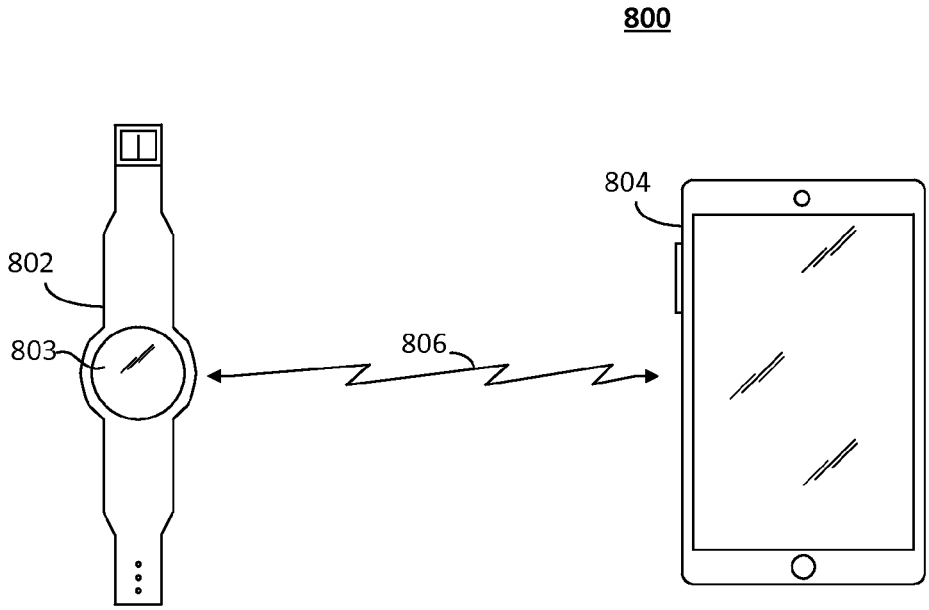
FIG. 8 is a system diagram of a wearable alert device paired with a mobile communication device in accordance with some embodiments.

FIG. 8 is a system diagram 800 of a wearable alert device 802 paired with a mobile communication device 804 in accordance with some embodiments. The wearable alert device 802 is in the form of a wrist strap having a pocket in which a puck device 803 is disposed. The puck device can be substantially similar to that shown in FIG. 2. The mobile communication device 804 can pair with the wearable alert device 802 using a personal area network radio link 806. The mobile communication device 804 can run one or more applications that can interact with, and/or respond to the wearable alert device 802 over the radio link 806.

For example, the user of the wearable alert device 802 can press and hold a button on the puck device 803, thereby generating an alert event, which prompts the puck device 803 to transmit an alert to the mobile communication device 804. In response, an application that is instantiated on the mobile communication device 804 can take some predetermined action (i.e. send a message, make a call, etc.). In another example, the mobile communication device can experience an event, such as, for example, receiving a phone call. In response, the mobile communication device can transmit an alert message to the wearable alert device 802, and alert the user by vibrating at the selected volume level, or according to a defined pattern. The pattern, if used, can be specified in the alert message, and can correspond to, for example, a particular contact associated in the mobile communication device.

Accordingly, embodiments of the disclosure herein provide the benefit of a wearable alert device that is simple to operate, and which allows the user, in some embodiments, to select a volume level to be used upon the occurrence of an alert event. The wearable alert device can be configured as a wrist strap that holds a puck device. The puck device can be removed from the wrist strap and placed in other structure if necessary. The puck device can be sealed so as to prevent intrusion of moisture and other matter.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description as part of the original disclosure, and remain so even if cancelled from the claims during prosecution of the application, with each claim standing on its own as a separately claimed subject matter. Furthermore, subject matter not shown should not be assumed to be necessarily present, and that in some instances it may become necessary to define the claims by use of negative limitations, which are supported herein by merely not showing the subject matter disclaimed in such negative limitations.

We claim:

1. A wearable alert device, comprising:

a housing enclosing a sealed volume;

an audio transducer disposed in the sealed volume;

a driver circuit disposed in the sealed volume that selectively drives the audio transducer in either a single ended mode or a double ended mode responsive to an enable signal;

control circuitry disposed in the sealed volume that includes a personal area network (PAN) interface and a clock signal source that produces a clock signal, and which applies the clock signal and enable signal to the driver circuit responsive to receiving an alert message at the PAN interface, wherein the enable signal is controlled to have a state that is on, off, or alternating based on an audio profile used responsive to receiving the alert message.

2. The wearable alert device of claim 1, wherein the audio transducer is a piezo element having a resonant frequency band, wherein a frequency of the clock signal is not in the resonant frequency band and produces a maximum sound pressure level outside the wearable alert device.

3. The wearable alert device of claim 1, wherein the audio profile is received in the alert message.

4. The wearable alert device of claim 1, further comprising a button on an external portion of the wearable device that is electrically connected to the control circuitry, and responsive to the an actuation of button the control circuitry either uses either the on or off state of the enable signal.

5. The wearable alert device of claim 1, wherein the driver circuit further includes a gating element to selectively enable or disable application of the clock signal to the audio transducer responsive to a gating signal provided by the control circuitry in accordance with the audio profile.

6. The wearable alert device of claim 1, wherein the driver circuit comprises:

an AND gate having two inputs electrically connected together that receive the clock signal, and having an AND output connected to a first driving terminal of the audio transducer; and a NOR gate having a first input electrically connected to the inputs of the AND gate, a second input that received the enable signal, and a NOR output connected to a second driving terminal of the audio transducer.

7. The wearable alert device of claim 1, wherein the audio profile indicates a duty cycle of the enable signal to alternately drive the audio transducer in the single ended mode and the double ended mode in accordance with the duty cycle.

8. The wearable alert device of claim 1, wherein the housing is configured in a puck, the wearable alert device further includes a wrist strap having a pocket in which the puck can be retained by the wrist strap.

9. A wearable alert device, comprising:

an audio transducer comprising a first terminal an a second terminal;

a driver circuit disposed in the sealed volume that selectively drives the audio transducer in either a single ended mode or a double ended mode responsive to an enable signal;

an audio driver circuit comprising:

a first driver logic path that outputs a first drive signal to the first terminal of the audio transducer and that corresponds to an input clock signal provided to the first driver logic path; and a second driver logic path that outputs a second drive signal to the second terminal of the audio transducer and that is responsive to an enable signal to output the second drive signal as a constant output when the enable signal is in a first state and to output the second drive signal as an inverted signal that is an inverted version of the first drive signal when the enable signal is in a second state.

10. The wearable alert device of claim 9, wherein the second driver logic path comprises an NOR gate having a first input and a second input, the first input receiving the input clock signal provided to the first driver logic path, and the second input receiving the control signal.

11. The wearable alert device claim 9, wherein the second driver logic path comprises an NOR gate having a first input and a second input, the first input receiving the output of the first driver logic path, and the second input receiving the enable signal.

12. The wearable alert device of claim 9, wherein the audio transducer is a piezo transducer having a resonant frequency and the audio driver circuit is disposed in a wearable alert device having a resonant frequency that is different than the resonant frequency of the piezo transducer, the input clock signal is selected to be in a resonant frequency band of the wearable alert device.

13. The wearable alert device of claim 12, wherein audio driver circuit is disposed in a sealed volume of the wearable alert device.

14. The wearable alert device of claim 13, wherein when the enable signal is in the second state an amplitude of vibrations produced by the wearable alert device is at least 3 decibels higher than when the enable signal is in the first state.

15. A method of driving an audio transducer in an alert device, comprising:

detecting an occurrence of an alert event by the alert device;

responsive to detecting the occurrence of the alert event, determining a drive mode for driving the audio transducer, wherein the drive mode is one of a single ended mode and a double ended mode;

responsive to determining that the drive mode is the single ended mode, driving the audio transducer using the single ended mode; and responsive to determining that the drive mode is the double ended mode, driving the audio transducer using the double ended mode.

16. The method of claim 15, wherein determining the drive mode comprises determining a volume setting, wherein a low volume setting indicates the single ended mode and a high volume setting indicates the double ended mode.

17. The method of claim 16, wherein the alert device includes a button, the method further comprises detecting an actuation of the button and toggling the volume setting in response to detecting actuation of the button.

18. The method of claim 15, wherein driving the transducer comprises:

when the determined mode is the single ended mode, providing a clock signal to a driver circuit which drives a first terminal of the audio transducer in correspondence with the clock signal and wherein an inverting element of the driver circuit is disabled and provides a ground to a second terminal of the audio transducer; and when the determined mode is the double ended mode, providing a clock signal to a driver circuit which drives the first terminal of the audio transducer in correspondence with the clock signal and wherein the inverting element of the driver circuit is enabled and provides an inverted clock signal to the second terminal of the audio transducer.

19. The method of claim 15, wherein detecting the occurrence of the alert event comprises detecting an output of an accelerometer of the alert device exceeding a preselected threshold acceleration level.

20. The method of claim 15, wherein detecting the occurrence of the alert event comprises receiving an alert message from an associated device of a radio frequency transceiver of the alert device.

* * * * *